US007496285B2

(12) United States Patent
Molavi

(10) Patent No.: US 7,496,285 B2
(45) Date of Patent: Feb. 24, 2009

(54) MULTI-PASS PARALLEL-TUBE HEAT EXCHANGER

(75) Inventor: Anthony S. Molavi, Dublin, OH (US)

(73) Assignee: Liebert Corporation, Columbus, OH (US)

( * ) Notice: Subject to any disclaimer, the term of this patent is extended or adjusted under 35 U.S.C. 154(b) by 501 days.

(21) Appl. No.: 10/892,572

(22) Filed: Jul. 16, 2004

(65) Prior Publication Data

US 2006/0278379 A1 Dec. 14, 2006

Related U.S. Application Data

(60) Provisional application No. 60/488,249, filed on Jul. 18, 2003.

(51) Int. Cl.
*F24H 1/10* (2006.01)

(52) U.S. Cl. ..... 392/486; 392/465; 392/485

(58) Field of Classification Search ..... 165/143; 392/490

See application file for complete search history.

(56) References Cited

U.S. PATENT DOCUMENTS

| | | | | |
|---|---|---|---|---|
| 1,918,601 A | | 7/1933 | Jacocks et al. | |
| 3,151,672 A | * | 10/1964 | Edmund | 165/143 |
| 3,705,622 A | * | 12/1972 | Schwarz | 165/143 |
| 3,791,326 A | | 2/1974 | Schwartz | |
| 4,210,199 A | * | 7/1980 | Doucette et al. | 165/70 |
| 4,326,582 A | * | 4/1982 | Rosman et al. | 165/83 |
| 4,989,670 A | * | 2/1991 | Foley | 165/143 |
| 5,121,791 A | * | 6/1992 | Casterline | 165/143 |
| 5,129,034 A | * | 7/1992 | Sydenstricker | 392/486 |
| 2004/0035566 A1 | * | 2/2004 | Hayashi et al. | 165/157 |

FOREIGN PATENT DOCUMENTS

| | | |
|---|---|---|
| CH | 424835 | 11/1966 |
| EP | 0067799 | 12/1982 |
| GB | 1434754 | 5/1976 |
| JP | 52001746 | 1/1977 |

* cited by examiner

*Primary Examiner*—Thor S Campbell
(74) *Attorney, Agent, or Firm*—Locke Lord Bissell & Liddell LLP

(57) ABSTRACT

A multi-pass parallel tube heat exchanger is disclosed. The multi-pass parallel tubes heat exchanger provides a compact, light and inexpensive heat exchanger that may be oriented in any direction. These features and others make the disclosed exchanger ideal for use in a restricted area such as that available when providing localized cooling systems. This design is more efficient than the prior art and allows for a versatile operation with multiple circuiting options for the flow path and enhanced performance with multiple fluid and heat transfer operations.

20 Claims, 7 Drawing Sheets

24

24
22
27
26

27
24

20
20
28
26
25
22
26

MULTI-PASS PARALLEL-TUBE HEAT EXCHANGER

CROSS-REFERENCE TO RELATED APPLICATIONS

This application claims the benefit of U.S. provisional application No. 60/488,249 filed Jul. 18, 2003, the entire disclosure of which is incorporated herein by reference.

BACKGROUND OF THE INVENTION

Refrigeration systems often use various types of heat exchangers, such as plate-to-plate, co-axial or shell and tube, as an evaporator or a condenser. In many applications, shell and tube heat exchangers are employed as condensers. However, shell and tube type heat exchangers suffer from several drawbacks and limitations.

In certain condenser applications, heat exchanger tubing can become clogged if the supply fluid is not cleaned. Unlike plate-to-plate and co-axial heat exchangers, shell and tube heat exchangers can be cleaned, but this is often difficult, time consuming and messy. Generally, the cleaning of a shell and tube exchanger requires removal of the shell-and-tube heads and the gasket positioned between the heads and the shell body. This takes time and often requires special tools. Further, when the cleaning operation is complete, a replacement gasket must be repositioned and the heads reattached. This operation again can be time consuming and improper positioning of the new gasket, improper coupling of the head to the shell, or failure to use a new gasket can render the exchanger inoperable.

In addition, shell and tube heat exchangers are often limited in terms of the flow patterns they can provide for the shell-side fluid relative to the tube-side fluid. Conventional shell and tube heat exchangers generally provide for "cross-flow" between the fluids. The availability of only cross-flow in conventional shell and tube heat exchangers is often limiting on the performance that can be obtained from such devices. Conventional shell and tube exchangers are often restricted to specific flow circuit arrangements or are costly to modify.

A still further limitation of conventional shell and tube exchangers is their size. Because conventional shell and tube exchangers typically include a large number of tubes positioned within an even larger shell, the overall size of such exchangers is often quite large and, typically, well over six inches in outer diameter. Moreover, because of the design of shell-and-tube exchangers, the design of the unit is often restricted to a particular configuration and shape and is further restricted to a unit that must be positioned in a horizontal orientation. The large size and configuration requirements of such shell-and-tube exchangers not only causes problems in terms of space and positioning requirements but it also often requires that the shell, in essence a large pressure vessel, include a pressure relief valve and meet various other standards, for example pressure vessel codes promulgated by the American Society of Mechanical Engineers (ASME), that apply to large pressure vessels.

The size drawback resultant from shell-and-tube exchangers is becoming even more problematic as regulations controlling the use of various refrigerants are implemented. Many conventional shell-and-tube exchangers were constructed to utilize azeotropic refrigerants. Regulations are being implemented that will require the use of non-azeotropic refrigerants such as R-407C. In general, non-azeotropic refrigerants are less effective than azeotropic refrigerants. As a result, to achieve the same general performance, a shell-and-tube exchanger designed to operate with non-azeotropic refrigerants must be sized approximately 20% larger than a similar shell-and-tube exchanger designed for azeotropic refrigerants. Such a size increase further exacerbates the size difficulties posed by shell-and-tube exchangers.

The size limitations posed by shell-and-tube exchangers is still further exacerbated when such exchangers are used as condensers or when sub-cooling or de-superheating is required. In certain cases, when a shell-and-tube exchanger is used as a condenser, an external receiver tank may be used for storing the refrigerant necessary to operate the system. The external receiver tank requires yet more space. Similarly, if sub-cooling or de-superheating is required, a shell-and-tube exchanger must be further oversized or a separate, space-taking, sub-cooler or de-superheater must be coupled to the unit.

The limitations and disadvantages of shell-and-tube exchangers are especially acute in certain applications, such as applications associated with cooling systems for electronic equipment. In such applications, an environmental control unit is typically positioned within a small contained space in a building where the computer servers and other electronic equipment required for the operation of the building are centrally located. Because such rooms are typically perceived as overhead to the main business of an organization, there is a great desire to make the rooms as small as possible. Moreover, because such rooms are typically established in existing buildings, there are often space and sizing requirements. The use of large, size- and configuration-restricted shell-and-tube exchangers in such applications has been of particular concern.

It is an object of the present disclosure to provide solutions to overcome or reduce the above-described and other disadvantages and limitations.

SUMMARY OF THE PRESENT DISCLOSURE

The present invention is directed to various aspects of a parallel-tube heat exchanger. A heat exchanger in some of the teachings of this disclosure includes a plurality of shell tubes with a plurality of parallel tubes disposed within each of the shell tubes. First and second header assemblies are coupled to the ends of the shell tubes so as to provide a fluid flow path between the parallel tubes disposed within the shell tubes. One or more nipples are provided to create a fluid flow path through the plurality of shell tubes. The heat exchanger may also have one or more access ports for cleaning the parallel pipes located in the header assemblies. Pressure relief valves may also be incorporated in the heat exchanger shell tubes. One or more diverter plates may be positioned within the header assemblies so as to define a fluid flow path through the heat exchanger.

Furthermore, a heat exchanger in accordance with certain aspects of the present disclosure may be utilized with any kind of cooling fluid. The heat exchanger's multiple functionality also allows it to be used as a condenser (with a separate sub-cooler circuit option within the same heat exchanger module), a de-superheater, an evaporator (with a separate de-superheater circuit option within the same heat exchanger module) or for fluid-to-fluid cooling, heat recovery and suction accumulator heat exchanger applications.

The heat exchanger may also be effectively operated in any position or orientation. Furthermore, the present invention can be made from any desired material including standard piping. As such, the heat exchanger may be manufactured so it is not an ASME vessel and, thus, does not require a pressure-relief valve. This design also makes the present invention lighter, cheaper, easier to manufacture, easier to clean and easier to alter or reconfigure.

Figure 1:
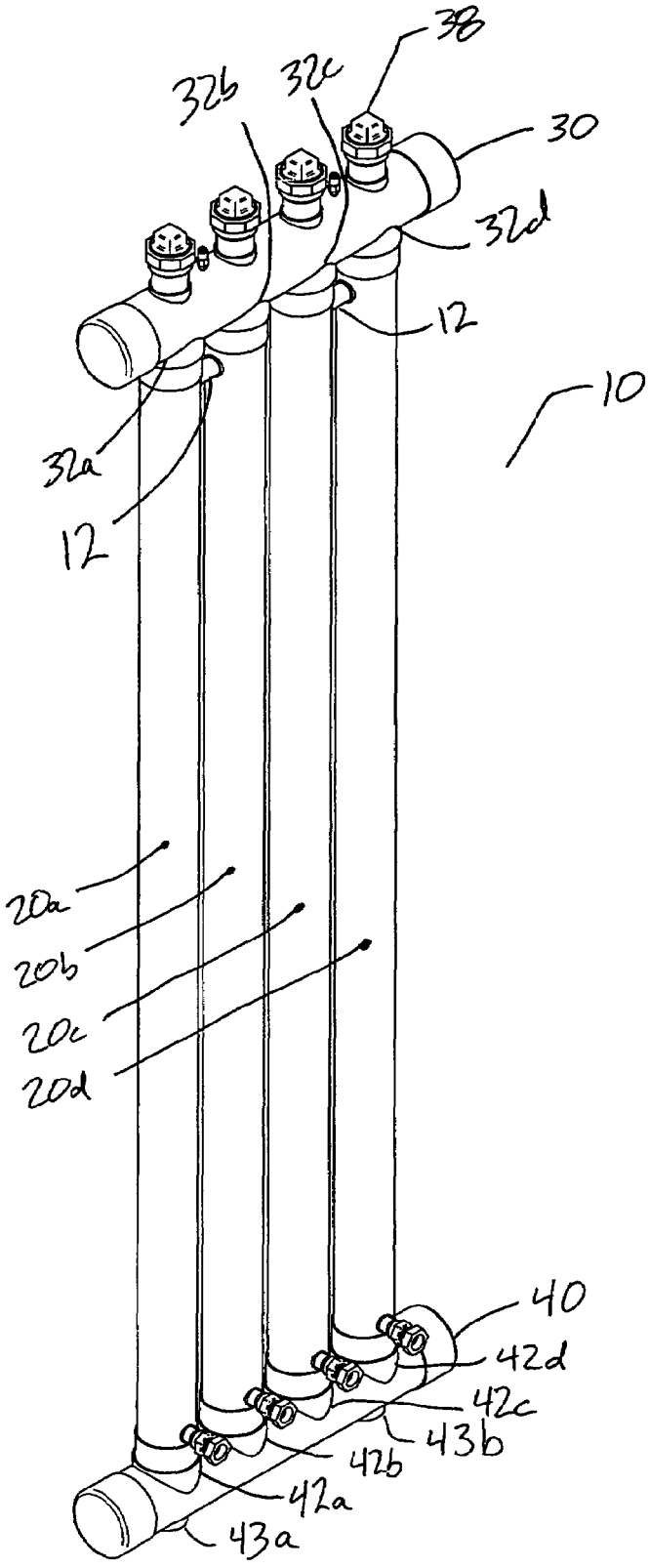
FIG. 1 illustrates a parallel-tube heat exchanger incorporating certain aspects of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is intended to cover all modifications, equivalents and alternatives falling within the scope of the invention as defined by the appended claims.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Turning to the drawings, particularly FIG. 1, a multi-pass parallel-tube heat exchanger 10 constructed in accordance with certain teachings of this disclosure is illustrated. Heat exchanger 10 is formed from a number of shell-tubes 20. Each shell-tube includes an outer shell that defines a first fluid enclosure within the outer shell. The first fluid enclosures within certain shell-tubes 20 are coupled in fluid communication by nipples 12. A plurality of smaller tubes (not illustrated in FIG. 1) are positioned within shell-tubes 20 and pass through the first fluid enclosures. The interiors of at least some of the smaller tubes are coupled in fluid communication by upper and lower headers 30 and 40 and, thus, define a second fluid enclosure. By passing fluids of differing temperatures through the first and second fluid enclosures, heat exchange may be effected. Additional details of the illustrated heat exchanger are provided below.

As illustrated in FIGS. 2A-2D, each of the shell-tubes 20 is formed from an outer shell 22, two end-caps 24 and 25 and a number of parallel tubes 26 positioned within the outer shell 22. The outer shell 22 is generally a tube of circular cross-section with openings formed, for example, from copper tubing, stainless steel, carbon steel, copper-nickel, aluminum, or any other suitable material. Although the illustrated embodiment includes circular tubes, it is possible to use tubes having other cross-sections.

In the illustrated embodiments, the parallel tubes 26 are positioned within the outer shell 22 and the ends of the parallel tubes 26 pass through openings or holes formed in the end-caps 24 and 25. The parallel tubes 26 may be formed from the same material as the outer shell 22. The end-caps 24 and 25 are coupled to the outer shell 22 through a fluid-tight connection, such that the interior of the outer shell 22 forms an enclosure that is not in fluid communication with the interior of the parallel tubes 26. Inlet and outlet openings 27 and 28 are formed in the outer shell 22, thus allowing access to the enclosure formed within the outer shell 22. In some examples, a sight glass may be coupled to communicate with the interior of the outer shell 22 to enable user verification that fluid is flowing within the outer shell 22.

To ensure proper operation, the outer shell may be constructed to withstand a pressure of five times the working pressure on the refrigerant side and a pressure of approximately two times the working pressure on the water (or fluid) side. Additionally, when the first enclosure will be used to receive refrigerant, the shell should be shipped and maintained in a dehydrated state before use. The parallel tubes should be constructed to meet or exceed any applicable ASME or U.L. 1995 pressure requirements.

The end caps 24 and 25 may be coupled to the outer shell 22 by, for example, brazing or welding. If the end caps 24 and 25 are brazed to the outer shell 22, the brazing materials may be selected to be compatible with the brazing materials C-12200 ASTM SB75/389. In some instances, it may be necessary to expand portions of the parallel tubes 26 passing through or near the end caps 24 and 25 to provide an interference fit as may be needed to form a water-tight joint between the parallel tubes 26 and the end caps 24 and 25.

Figures 2A, 2B, 2C, 2D:
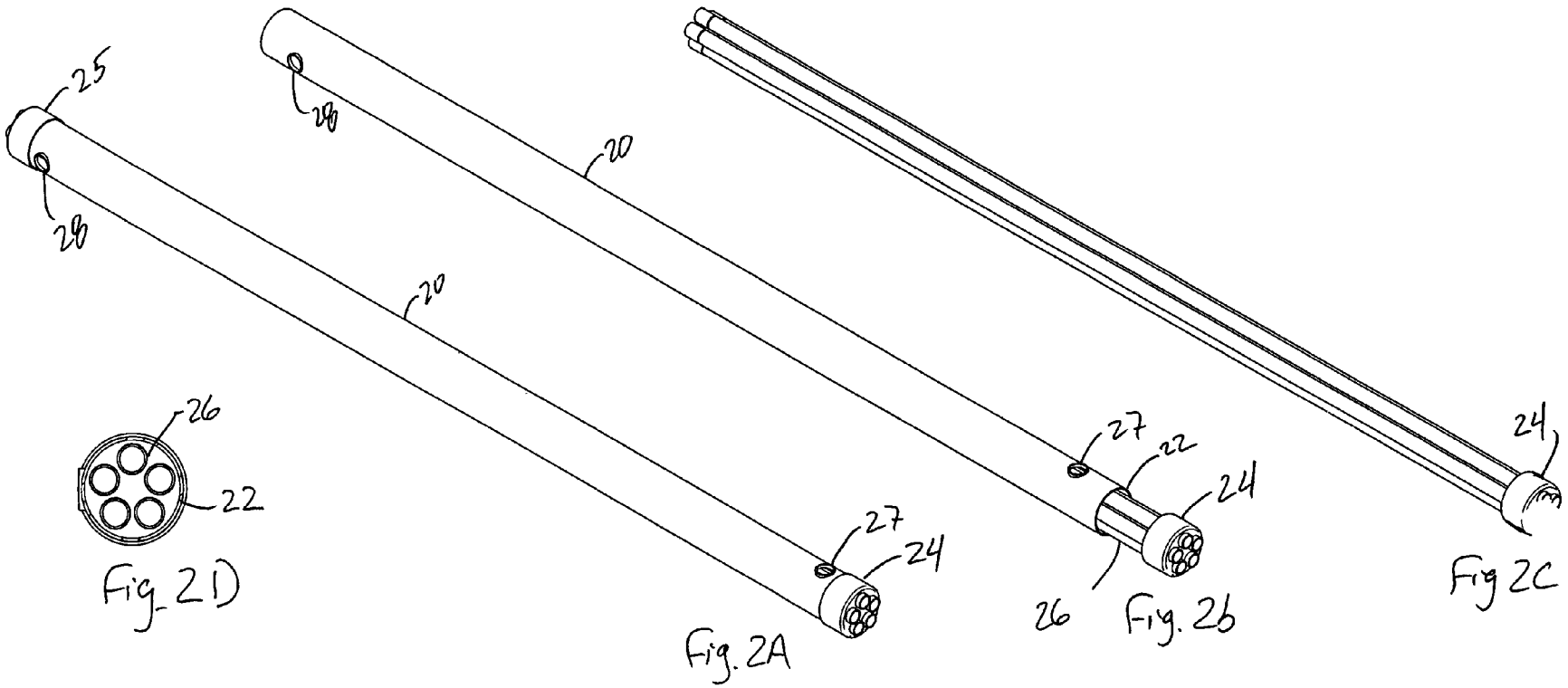
FIGS. 2A-D illustrate the construction of one of the shell tube elements of a parallel-tube heat exchanger in accordance with certain teachings of the present disclosure.

Referring to FIG. 2D, in the illustrated example there are five parallel tubes 26 positioned within outer shell 22. It will be appreciated that a greater or lesser number of parallel tubes 26 may be used without departing from the teachings of the present disclosure. Regardless of the number of parallel tubes 26 contained in the outer shell 22, it is believed to be beneficial to have the parallel tubes 26 arranged uniformly within the outer shell 22.

While the dimensions of the outer diameter of the outer shell 22 and the parallel tubes 26 will vary from application to application, it is desirable to maintain certain dimensions for certain components. For example, it is preferable to ensure that the inner diameter of the outer shell is less than three inches so that a pressure relief valve is not required under the applicable codes and standards. To accommodate this requirement, shell 22 may be constructed of 3⅝" or 2⅝" tubing. In such cases, to accommodate the connection between the shell tubes 22 and the upper and lower headers 30 and 40, the headers may be manufactured with either 3⅝" tubing or 3⅛" tubing, respectively. Three-quarter inch tubing may be used for the parallel tubes 26.

To maximize heat exchange and minimize space, it is also believed to be beneficial to control the number of parallel tubes positioned within the outer shell for each application.

Applications involving three to eight tubes are currently envisioned, but differing application requirements may call for other numbers of tubes.

Referring back to FIG. 1, it may be noted that in the illustrated example, the heat exchanger 10 is formed from four shell-tubes 20 coupled together though through the use of nipples 12, top header 30 and bottom header 40. Each nipple 12 is coupled to the outlet opening of one of the shell-tubes 20 and to the inlet opening of another shell-tube 20. In this manner, the arrangement illustrated in FIG. 1 provides a fluid path for fluid to flow into the inlet of one of the shell-tubes 20 (for example, the inlet opening 27*a* of the topmost shell-tube 20*a*) through the enclosure formed by the outer shell of shell-tube 20*a*, through nipple 12*a*, into the enclosure formed by the outer shell of shell-tube 20*b* and so on until the fluid passes out of the outlet opening 28*d* of shell-tube 20*d*. An additional advantage of a heat exchanger constructed in accordance with certain aspects of the present disclosure over conventional shell and tube heat exchangers is that fluid may be inserted at any open port. Thus, the heat exchanger can be reconfigured more easily than those of the prior art.

In the embodiment of FIG. 1, headers 30 and 40 are coupled to the end caps 24 and 25 of the shell-tubes 20 by, for example, brazing or welding. In the illustrated embodiments, the headers 30 and 40 establish fluid communications between the interiors of the parallel tubes 26 within the shell-tubes 20. Details of the exemplary headers 30 and 40 are provided in FIGS. 3 and 4.

Figure 3A:
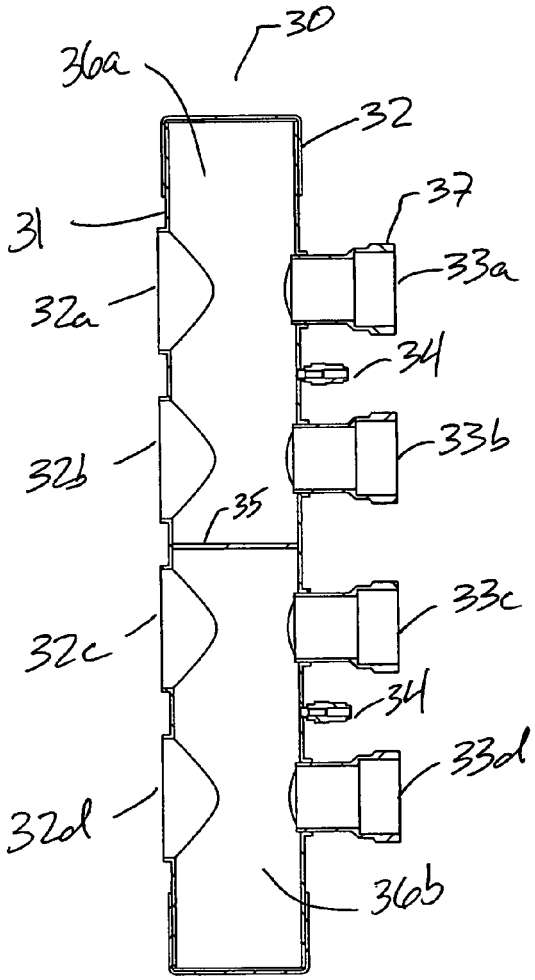
FIGS. 3A-B illustrates the top header construction of a parallel-tube heat exchanger incorporating certain aspects of the present disclosure.
Figure 3B:
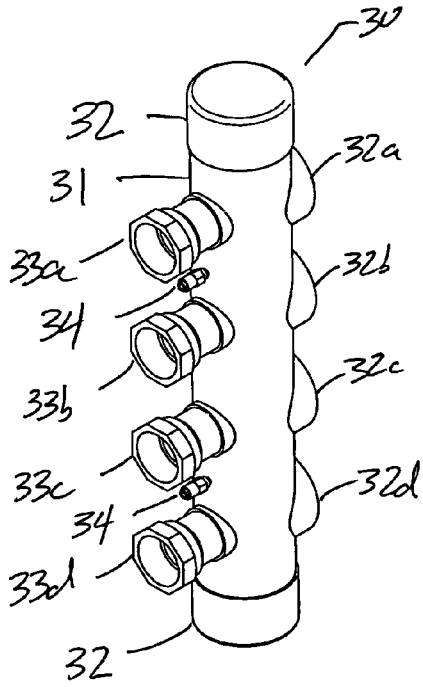

Referring to FIGS. 3A and 3B, exemplary details of an exemplary top header 30 are provided. In general, top header 30 includes a generally tubular structure 31 and end caps 32 coupled to the ends of the tubular structure 31 through a fluid-tight coupling. Tubular structure 31 defines eight generally circular openings, with four of the openings 32*a*-32*d* defining circular flanges having a first diameter, and the remaining openings 33*a*-33*d* define circular flanges having a second diameter, where the second diameter is smaller than the first diameter. In the exemplary embodiment of FIG. 3, the center of each circular opening 32*a*-32*d* is aligned with the center of corresponding circular opening 33*a*-33*d* such that a substantially straight cleaning element (e.g., a brush) can pass straight through a given second circular opening (e.g., 32*a*) and its corresponding first circular opening (e.g., 33*a*) without significant bending.

In the exemplary embodiment, in addition to the eight openings discussed above, tubular structure 32 further defines two smaller openings 34 providing access to the interior of the structure 32. In the illustrated embodiment, valves are affixed to flanges defined by openings 34 in a watertight manner. These valves allow for the release of pressure from the interior of the outer shell and may be used to remove bubbles from the interior of the outer shell 22 during the initial filling and running of the heat exchanger.

In the illustrated structure, a diverter plate 35 is positioned within the tubular structure 32 so as to divide the tubular structure 32 into two separate and fluidly isolated sections 36*a* and 36*b*. This division allows for the establishment of two separate and distinct fluid paths.

In the illustrated embodiment of FIG. 3, adaptor elements 37 are coupled to each of the openings 33*a* and 33*b*. Each of these adaptor openings in the illustrated example includes an open end portion that is threaded and is capable of receiving a threaded plug 38 (not illustrated in FIG. 3). FIG. 1 illustrates in greater detail the positioning of threaded plugs 38 within the adaptor elements 37 of upper header 30. As discussed in more detail below, the use of adaptor elements 37 and threaded plugs 38 provides a structure that enables easy and gasketless cleaning of the interior portions of the parallel tubes 26.

Figure 4B:
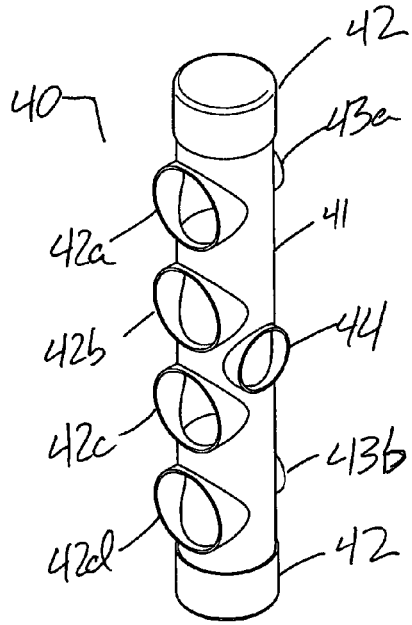
FIGS. 4A-B illustrates the bottom header construction of a parallel-tube heat exchanger incorporating certain aspects of the present disclosure.
Figure 4A:
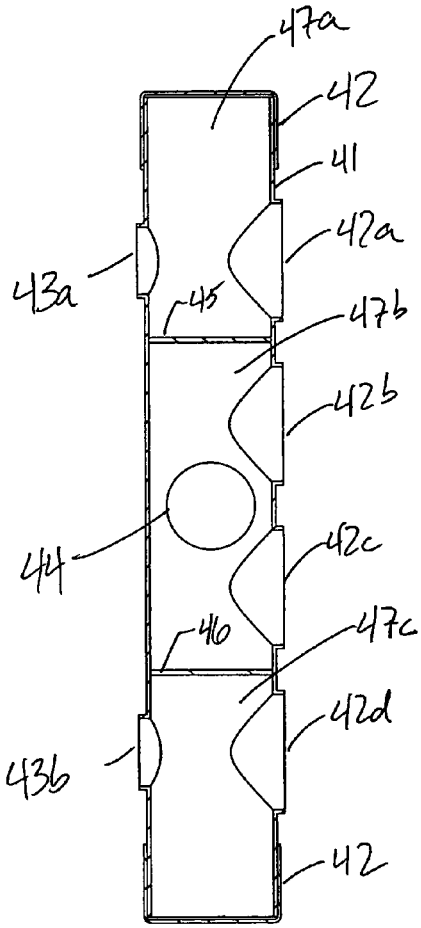

FIGS. 4A and 4B illustrate the construction of an exemplary bottom header assembly 40. In general, the construction of the bottom header assembly 40 is similar to that of the upper header assembly 30, in that, it is formed form a tubular structure 41 that is coupled in a watertight manner to end caps 42.

Tubular structure 41 defines seven generally circular openings, with four of the openings 42*a*-42*d* defining circular flanges having a first diameter; two of the remaining openings 43*a* and 43*b* define circular flanges having a second diameter, where the second diameter is smaller than the first diameter, and a third opening 44 having a third circular diameter. In the exemplary embodiment of FIG. 4, the center of each circular opening 43*a* and 43*b* is aligned with the center of a corresponding circular opening 42*a* and 42*d*, although alternate designs are envisioned. The bottom header assembly 40 includes two plate diverters 45 and 46, dividing the interior of the tubular structure 41 into three separate, fluidly isolated regions 47*a*, 47*b* and 47*c*.

As generally depicted in FIG. 1, the overall heat exchanger is constructed by coupling the ends of the shell tubes 20 to the openings 32*a*-32*d* and 42*a*-42*d* of the top and bottom header assemblies 30 and 40 and by coupling the interior of the shell tubes 20 to one another through the use of nipples 12.

In the specific exemplary heat exchanger described in connection with FIGS. 1-4B, the connections provide for two separate fluid paths that may be used to perform heat exchange operations as generally reflected in FIGS. 5A and 5B.

Figure 5B:
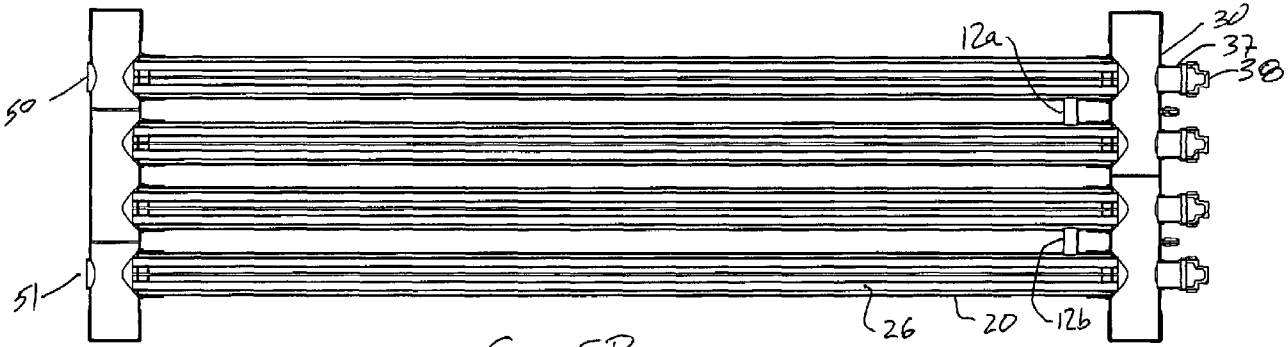
FIGS. 5A-B illustrates various aspects of the construction of a parallel-tube heat exchanger incorporating various aspects of the present disclosure.
Figure 5A:
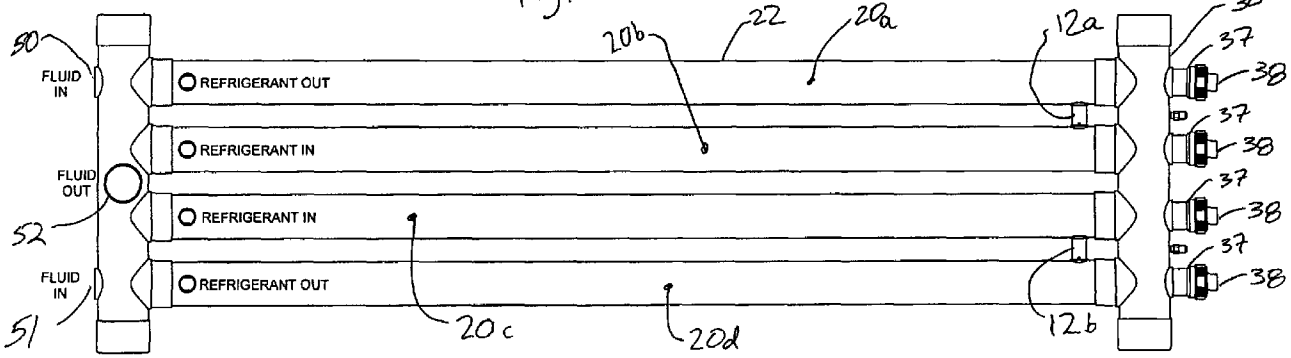

Referring to FIG. 5A, the heat exchanger is illustrated in the form in which it may be used where refrigerant is to be flowed into and out of the interior of the outer shells 22 forming the shell tubes 20 and cooling water or fluid is to be flowed into and out of the parallel tubes 26. FIG. 5B illustrates a cross-sectional cutaway of the heat exchanger of FIG. 5A.

In the specific example of FIGS. 5A and 5B, because of the positioning of the diverter plates in the headers and the arrangement of the nipples 12, there are multiple separate heat exchange paths.

First, there is a path for refrigerant into shell tube 20*b*, through nipple 12*a* and out of shell tube 20*a*. The first refrigerant path thus provides, in the illustrated example, that refrigerant will flow from left to right through the interior portion of the outer shell of shell tube 20*b*, through nipple 12*a* and from right to left through the interior portion of shell tube 20*a*. This first refrigerant path may be coupled, for example, to a first compressor.

Second, there is a second refrigerant path into the interior of the outer shell for shell tube 20*c*, through nipple 12*b* and out of shell tube 20*d*. The second fluid path thus provides, in the illustrated example, that refrigerant will flow from left to right through the interior portion of the outer shell of shell tube 20*c*, through nipple 12*b* and from right to left through the interior portion of shell tube 20*d*. This second refrigerant path may be coupled, for example, to a second compressor. Notably, the first and second refrigerant paths are completely isolated from one another in the illustrated example.

In addition to the two refrigerant paths discussed above, the heat exchanger of FIGS. 5A and 5B provides a fluid path for cooling fluid (e.g., water) into and out of the heat exchanger. The fluid is provided to the heat exchanger at two locations 50 and 51 on the bottom header, which is the leftmost header in FIGS. 5A and 5B. Because of the manner in which the diverter plates were positioned within the top and bottom headers, the cooling fluid (water) will flow into the bottom header, from left to right through the parallel tubes within shell tubes 20*a* and 20*d*, through top header 30 and right to left through the parallel tubes within shell tubes 20*b* and 20*c* and out exit port 52. Notably, the two cooling fluid paths are not isolated from one another but instead share a single exit port 52. By providing two isolated refrigerant paths, the heat exchanger 10 of FIGS. 5A and 5B can thus provide two condensing units within a single heat exchanger. This "two-in-one" construction not only saves space but is also very cost effective.

It may be noted that in the example discussed above in connection with FIGS. 5A and 5B, the flow of the cooling fluid is counter to the flow of the refrigerant. Thus, when refrigerant is flowing through the interior of the outer shell of a given shell tube in one direction (e.g., from left to right), cooling fluid will be flowing through the parallel tubes within the same shell tube in the opposite direction (e.g., from right to left). The above-described example's use of counter-flow is believed to significantly increase the overall heat transfer effectiveness of the system.

FIGS. 5A and 5B further illustrate the simplified cleaning approach that may be used with a heat exchanger constructed in accordance with certain teachings of this disclosure. As discussed above in the illustrated example, the top header assembly 30 (the rightmost header assembly in FIGS. 5A and 5B) includes openings generally aligned with the openings to which the shell tubes are coupled and adaptors that extend from such openings. The adaptors are formed with open ends that are threaded to receive threaded plugs 38. The use of the adaptors and threaded plugs 38 allows for easy, gasketless cleaning of the interior of the parallel pipes within the shell tubes. In the example of FIGS. 5A and 5B, it is the interior of the parallel tubes that will likely require cleaning as those tubes will receive the cooling fluid, which is typically dirty water as compared to the relatively clean refrigerant.

In the illustrated example, to clean the parallel tubes within the shell tubes 20*a*-20*d*, one need only unscrew or remove the screw plugs 38 and run a cleaning brush or other mechanical cleaner into the resultant opening through one of the parallel tubes. There is no need to significantly bend the cleaning brush as the opening provided by the adaptor 37 is aligned with the openings of the parallel tubes. Because a screw plug is used to seal the end of adaptor 37, there is no need for a gasket or for the replacement of a gasket as required when conventional shell and tube heat exchangers are cleaned.

As reflected in FIGS. 1 and 5A and 5B, the heat exchanger disclosed herein may advantageously be oriented in a variety of positions. For example, the heat exchanger 10 may be positioned horizontally or vertically or flat. Additionally, a heat exchanger may be constructed to have any of a variety of shapes and orientations using the teachings of this disclosure. For example, if the headers were redesigned to be U-shaped rather than straight, it would be possible to construct a heat exchanger where the shell tubes 20 were arranged in a two-by-two square. In general, the use of shell tubes as described herein in combination with specially designed headers and nipples enables the construction of heat exchangers of various -orientations that can allow for the positioning of heat exchange equipment in tight locations. Moreover, because the heat exchanger is formed from an assemblage of individual components, and no component is required to be large enough to house all other components as, for example, with a conventional shell and tube heat exchanger where the shell must be large enough to house all of the tubes forming the exchanger, the individual components may be individually brought to a location and the heat exchanger assembled at the location, thus potentially reducing shipment costs and potentially allowing the construction of a heat exchanger in locations that would be unsuitable for a conventional shell and tube exchanger. Thus, the heat exchanger described herein is highly adaptable and provides various shape options, allowing for compact construction.

It should be appreciated that the heat exchanger described in connection with the preceding figures can be modified in a variety of ways without departing from the teachings of the present disclosure. For example in the described heat exchanger, there are two independent refrigeration paths and two interconnected cooling fluid paths. Changes could be made in the construction of the headers, and additional shell tubes 20 could be added to provide for differing flow paths. This ability to provide multiple fluid circuits on either the cooling fluid side or the refrigerant side (or both) allows for the easy construction of heat exchangers meeting desired heat transfer and/or pressure drop requirements. In many instances, the circuiting of the cooling fluid and the refrigerant can be adjusted simply by controlling the positioning of diverter plates within the headers.

As another example, the heat exchanger of the present disclosure can be used as a condenser (as illustrated in FIG. 1 and FIGS. 5A and 5B) or as an evaporator. To use the heat exchanger disclosed herein as an evaporator, one need only add some internal baffles on the fluid side.

Still further the heat exchanger of the present disclosure may be effectively and efficiently used with a sub-cooler or a de-superheater. For purposes of illustration, only the sub-cooler application is discussed in detail. The de-superheater application will be apparent to those of ordinary skill in the art having the benefit of this disclosure.

Figure 6:
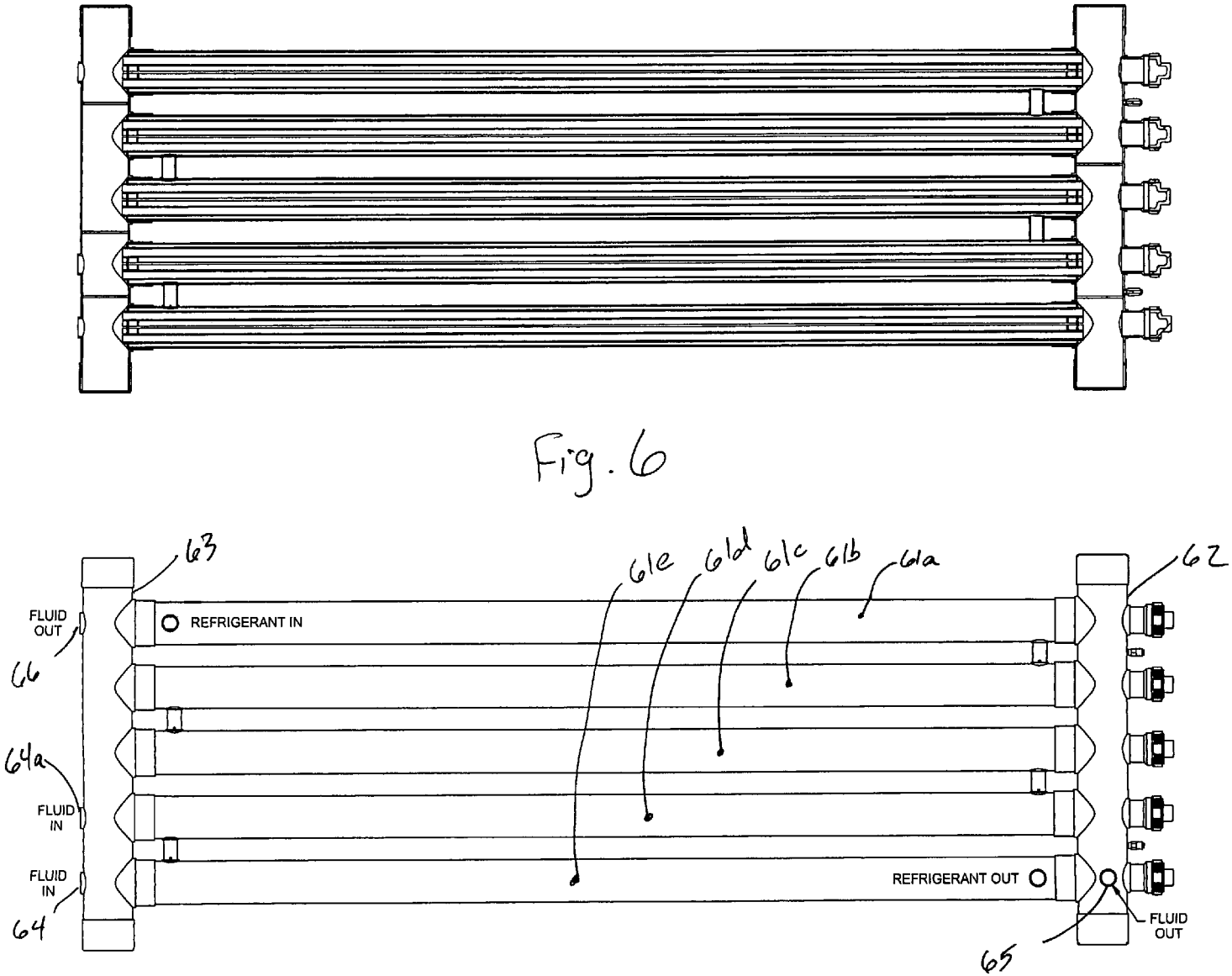
FIG. 6 illustrates a parallel-tube heat exchanger constructed in accordance with certain teachings of this disclosure that includes a single refrigerant circuit and a sub-cooler.

FIG. 6 generally illustrates another heat exchanger constructed in accordance with certain teachings of this disclosure. Particularly, the heat exchanger of FIG. 1 heat exchanger may be manufactured with a sub-cooling circuit as shown in FIG. 6. The refrigerant flows through the five shell tubes 61*a*-61*e* of the heat exchanger as follows: the refrigerant flows from left to right through the parallel pipes within shells 61*a*, 61*c*, and 61*e* and from right to left through the parallel pipes within shells 61*b* and 61*d*.

Diverter plates are positioned within the headers 62 and 63 to create two separate circuits for condenser and sub-cooling fluids. The cooling fluid enters the heat exchanger from port 64 and exits from port 65 for the sub-cooling circuit. The cooling fluid also enters the heat exchanger through port 64*a* and exits from port 66 for the condenser circuit.

While the example of FIG. 6 illustrates only one sub-cooling fluid circuit, alternate embodiments are envisioned wherein multiple cooling fluid circuits are provided and the temperatures of the cooling fluids within the various circuits differs. Moreover, alternate embodiments are envisioned wherein multiple refrigerant circuits and multiple cooling circuits are provide to control the temperature gradients across the heat exchanger. One benefit of the construction of a heat exchanger in accordance with certain teachings of this disclosure is that there is an essentially unlimited potential for combining refrigerant and cooling fluid circuit and multi-circuited on both the refrigerant and cooling fluid sides.

Figure 7:
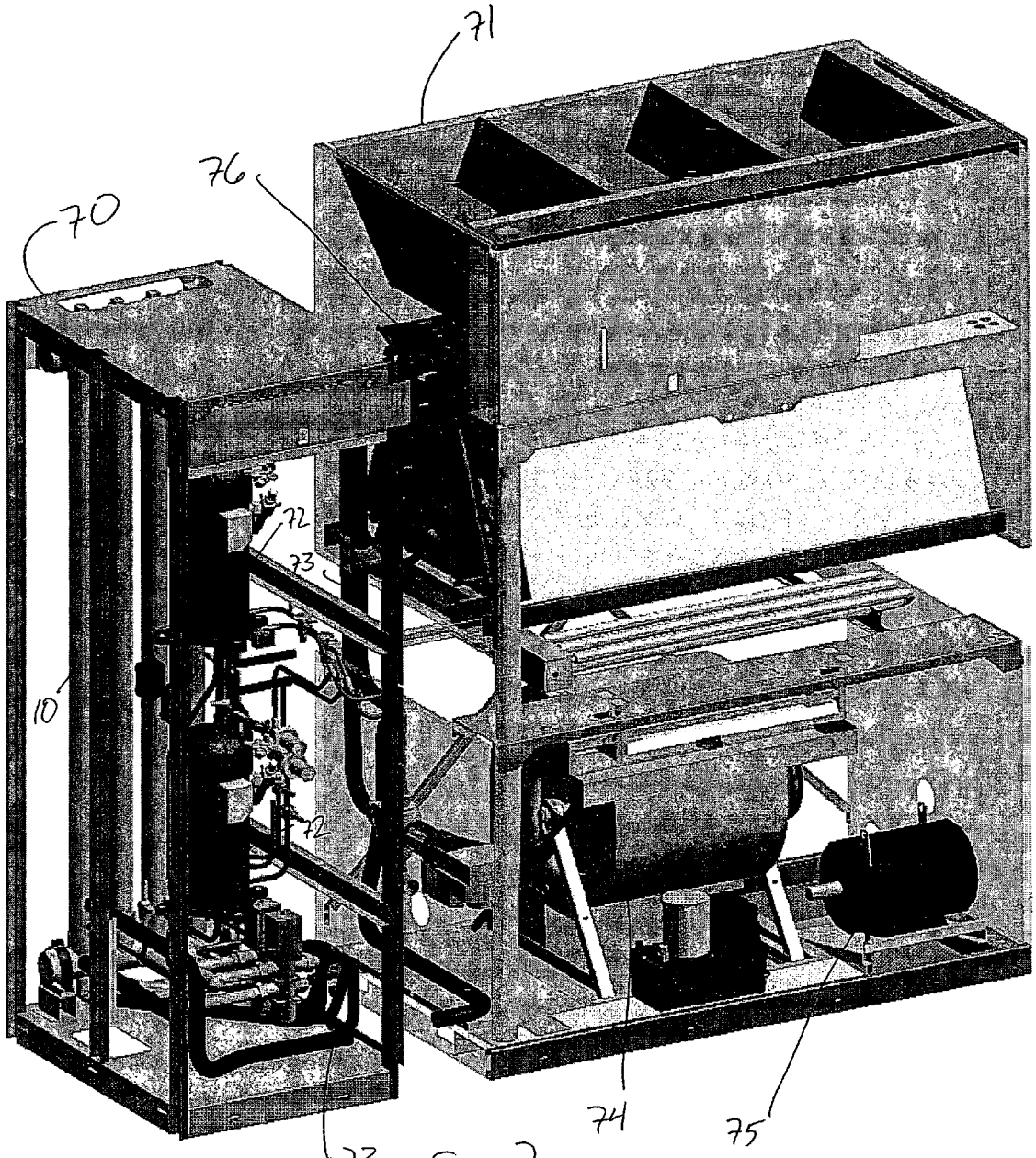
FIG. 7 illustrates an exemplary cooling system employing a parallel-tube heat exchanger constructed in accordance with certain aspects of the present disclosure.

A heat exchanger constructed in accordance with some or all of the teachings of this disclosure may be used to construct a cooling system generally illustrated in FIG. 7. As illustrated, parallel-tube heat exchanger 10 is mounted in the rearward portion of enclosure 70. Also included within enclosure 70 are compressors 72. In this application, heat exchanger 10 is configured as a condenser. The evaporator is included within enclosure 71 and is connected back to the compressors 72 and condenser 10 by various refrigerant lines 73. Blower 74, powered by blower motor 75, forces air through the evaporator 76 for cooling operation.

While the invention has been described with reference to the preferred embodiments, obvious modifications and alterations are possible by those skilled in the art. Therefore, it is intended that the invention include all such modifications and alterations to the full extent that they come within the scope of the following claims or the equivalents thereof.

What is claimed is:

1. A heat exchanger comprising:

a plurality of shell tubes;

a plurality of parallel tubes disposed within each of the shell tubes;

first and second header assemblies coupled to the ends of the shell tubes so as to provide a fluid flow path between parallel tubes disposed within a first shell tube and parallel tubes disposed within a second shell tube; and one or more nipples providing two isolated fluid flow paths through the plurality of shell tubes;

wherein a diameter of at least one shell tube is nominally three inches.

2. The heat exchanger of claim 1 wherein at least one of the header assemblies comprises one or more access ports for cleaning the parallel tubes.

3. The heat exchanger of claim 1 wherein at least one of the header assemblies comprises one or more pressure relief valves.

4. The heat exchanger of claim 1 wherein the header assemblies include inlet and outlet ports for a fluid flowing within the parallel tubes.

5. The heat exchanger of claim 1 wherein at least one of the header assemblies further comprises one or more diverter plates positioned within the header assemblies so as to define a fluid flow path through the heat exchanger.

6. The heat exchanger of claim 5, wherein the one or more diverter plates are configurable to define a plurality of isolated fluid flow paths through the exchanger.

7. The heat exchanger of claim 1 wherein the at least one shell tube is tubing that is nominally one of: 3⅝ inches 3½ inches 2⅝ inches, and 2½ inches.

8. The heat exchanger of claim 1 wherein at least one parallel tube is tubing that is nominally ¾ inches.

9. The heat exchanger of claim 1 wherein the number of parallel tubes is from three to eight.

10. A heat exchanger comprising:

two or more shell tubes;

a plurality of parallel tubes disposed within each of the shell tubes;

means for providing two isolated fluid flow paths through the shell tubes; and means for providing a counter fluid flow through the plurality of parallel tubes within each of the shell tubes;

wherein the shell tubes and the plurality of parallel tubes are oriented substantially vertically, an inside diameter of at least one shell tube is less than three inches, at least one parallel tube is a ¾ inch tubing, and the number of parallel tubes is from three to eight.

11. A heat exchanger for use in a cooling system having an enclosure and a compressor housed within the enclosure, the heat exchanger being connected to the compressor and comprising:

one or more shell tubes;

four nipples to provide two isolated fluid flow paths through the shell tubes a plurality of parallel tubes disposed within each shell tube; and wherein a diameter of at least one shell tube is nominally three inches.

12. The heat exchanger of claim 11 being selected from the group consisting of a condenser with a separate sub-cooler circuit option, a de-superheater, an evaporator with a separate de-superheater circuit option, a fluid-to-fluid cooling application, a heat recovery application, and a suction accumulator application.

13. The heat exchanger of claim 11 wherein the one or more shell tubes and the plurality of parallel tubes of the heat exchanger are oriented substantially vertically.

14. A heat exchanger having one or more shell tubes and a plurality of parallel tubes disposed within each of the shell tubes, comprising:

a first fluid flow through the one or more shell tubes;

a plurality of nipples providing at least two isolated fluid flow paths through the shell tubes;

a second fluid flow through the plurality of parallel tubes within each of the one or more shell tubes, the second fluid flow flowing in a direction opposite to a direction of the first fluid flow; and wherein the one or more shell tubes and the plurality of parallel tubes are oriented substantially vertically.

15. The heat exchanger of claim 14 wherein a diameter of at least one shell tube is nominally three inches.

16. The heat exchanger of claim 14 wherein at least one shell tube is tubing that is nominally one of: 3⅝ inches, 3½ inches, 2⅝ inches, and 2½ inches.

17. The heat exchanger of claim 14 wherein at least one parallel tube is tubing that is nominally ¾ inches.

18. The heat exchanger of claim 14 wherein the number of parallel tubes is from three to eight.

19. The heat exchanger of claim 14 wherein the first fluid flow is a non-azeotropic refrigerant having a substantial glide problem.

20. The heat exchanger of claim 14 wherein the first fluid flow is a refrigerant commercially known as R-407C.

* * * * *